US007249679B2

(12) United States Patent
Klein

(10) Patent No.: US 7,249,679 B2
(45) Date of Patent: Jul. 31, 2007

(54) EXPANSIBLE SHOE RACK

(75) Inventor: Richard B. Klein, Overland Park, KS (US)

(73) Assignee: Lynk, Inc., Lenexa, KS (US)

( * ) Notice: Subject to any disclaimer, the term of this patent is extended or adjusted under 35 U.S.C. 154(b) by 137 days.

(21) Appl. No.: 10/908,523

(22) Filed: May 16, 2005

(65) Prior Publication Data

US 2006/0254991 A1 Nov. 16, 2006

(51) Int. Cl.
*A47F 7/08* (2006.01)

(52) U.S. Cl. ..... 211/37; 211/204; 211/175

(58) Field of Classification Search ..... 211/37, 211/189, 175, 105.1–105.6, 201, 88.02, 90.02; 248/257, 259, 265, 333, 298.1, 354.1; 108/102, 108/137

See application file for complete search history.

(56) References Cited

U.S. PATENT DOCUMENTS 1,037,846 A * 9/1912 Anderson ..... 211/105.3
1,733,487 A 10/1929 Hackley
2,276,141 A * 3/1942 Atkinson ..... 211/37
2,492,517 A * 12/1949 Bernick ..... 211/123
2,945,595 A * 7/1960 Gardner, Jr. ..... 211/105.3
2,969,881 A * 1/1961 Lilly ..... 211/105.3
3,888,353 A 6/1975 Leifheit
4,854,456 A * 8/1989 Lee ..... 211/14
5,617,959 A * 4/1997 Klein et al. ..... 211/37
D403,880 S 1/1999 Malik
5,992,647 A * 11/1999 Malik ..... 211/34
D424,320 S * 5/2000 Klein et al. ..... D6/411
6,123,208 A * 9/2000 Haenszel ..... 211/175
6,364,129 B1 * 4/2002 Dardashti et al. ..... 211/40
6,834,768 B2 * 12/2004 Jersey et al. ..... 211/189
7,000,787 B2 * 2/2006 Felsenthal ..... 211/175

* cited by examiner

*Primary Examiner*—Jennifer E. Novosad
(74) *Attorney, Agent, or Firm*—Blackwell Sanders Peper Martin LLP

(57) ABSTRACT

A self-standing shoe rack or other type of shoe rack such as a hanging shoe rack which can expand lengthwise due to telescoping shoe support bars. Opposite frame sides may have equal-size sockets that receive identical end tubes. The end tubes fit telescopically in center tubes to allow length adjustment.

18 Claims, 3 Drawing Sheets

EXPANSIBLE SHOE RACK

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

This invention relates generally to shoe racks and more particularly to a self-standing shoe rack or other type of shoe rack that can be expanded to vary its capacity for holding shoes.

BACKGROUND OF THE INVENTION

Efforts have been made to provide shoe racks that can be expanded and contracted in order to vary their capacity and allow them to fit in whatever area is available. For example, U.S. Pat. No. 3,888,353 to Leifheit and U.S. Pat. No. D403,880 to Malik disclose shoe racks having telescoping tubes on which shoes are supported. The tubes can be adjusted telescopically in length to vary the length and capacity of the shoe rack. However, in both of these shoe racks, there are two telescoping tubes that have different diameters, and the sockets that receive the tubes on the shoe rack frame must have different sizes. This size difference leads to practical problems.

First, this type of unit is normally assembled by consumers who generally lack assembly skills. Inevitably, a large number of purchasers will attempt to assemble the unit by trying to drive the larger tube into one of the smaller sockets. Not only will this not work, it is likely to crack or otherwise damage the frame, especially considering that the frames are typically constructed of plastic. In addition to the damage, there can be considerable frustration involved that can harm the reputation of the product.

A construction that uses two telescoping tubes also limits the capacity of the shoe rack as a practical matter. The two tubes must have some overlap, so the overall length of the shoe rack must be less than twice the length of the longer of the two tubes. Retail stores limit the length of the packaging they will accept, so the practical effect is that the shoe rack must have a maximum length less than twice the length of the package.

SUMMARY OF THE INVENTION

The present invention is directed to an expansible shoe rack having a unique construction that overcomes these problems in a practical way.

In particular, it is an object of the invention to provide an expansible shoe rack in which the sockets that receive the telescoping tubes all have the same size. This feature is accomplished in a preferred embodiment by providing tubes that are equal in size for insertion into the sockets on opposite sides of the shoe rack frame, along with a center tube that has a different size so that it can establish a telescopic fit with the end tubes, thereby accommodating expansion and contraction of the shoe rack size and capacity.

Another object of the invention is to provide an expansible shoe rack that has enhanced capacity without the need for lengthy tubes or lengthy packaging.

In accordance with a preferred embodiment of the invention, a shoe rack has a frame with opposite sides that each present a plurality of equally sized sockets. Bar assemblies that extend between the sides to provide support for shoes include end tubes that closely fit in the sockets and center tubes that fit telescopically with the end tubes. The bar assemblies are arranged in tiers, with front and rear bars in each tier for receiving and supporting the shoes.

By virtue of this construction, all of the sockets and all of the end bars can have the same size. Therefore, consumers can apply the end bars to the sockets without the chance of a size mismatch. Preferably, the center bars are noticeably longer than the end bars so they are readily distinguished and will not mistakenly be driven into the sockets.

This construction has the added advantage of providing increased capacity without lengthening the packaging. By way of example, an 8' long (maximum) shoe rack with two tubes would have at least one tube that is at least 4½' long, assuming a 6" overlap between the two tubes. The package length would thus have to be more than 4½'. In contrast, an 8' shoe rack (maximum) constructed according to the present invention could have two end tubes each 2½' long and a center tube 4' long, again assuming a 6" overlap at each of the two telescopic joints. The package could be at least 6" shorter than in the case of a two tube unit while providing the same capacity. Even greater advantage can be obtained in this respect by using other length combinations of the tubes.

It is preferable for each frame side to be constructed using a base, front and back posts, and a top beam that connects the upper ends of the posts. The connections between the posts and the base and top beam may be detachable so that the shoe rack can be packaged in a compact configuration. One set of sockets can be provided in each base and each top beam so that the opposite posts, base pieces and top beams are all connected by tube assemblies, while the posts, bases and top beams on each side are directly connected to each other to enhance the structural integrity and rigidity of the shoe rack construction.

Other and further objects of the invention, together with the features of novelty appurtenant thereto, will appear in the course of the following description.

BRIEF DESCRIPTION OF THE SEVERAL VIEWS OF THE DRAWINGS

In the accompanying drawings which form a part of the specification and are to be read in conjunction therewith and in which like reference numerals are used to indicate like parts in the various views.

DETAILED DESCRIPTION OF THE PREFERRED EMBODIMENT

Figure 3:
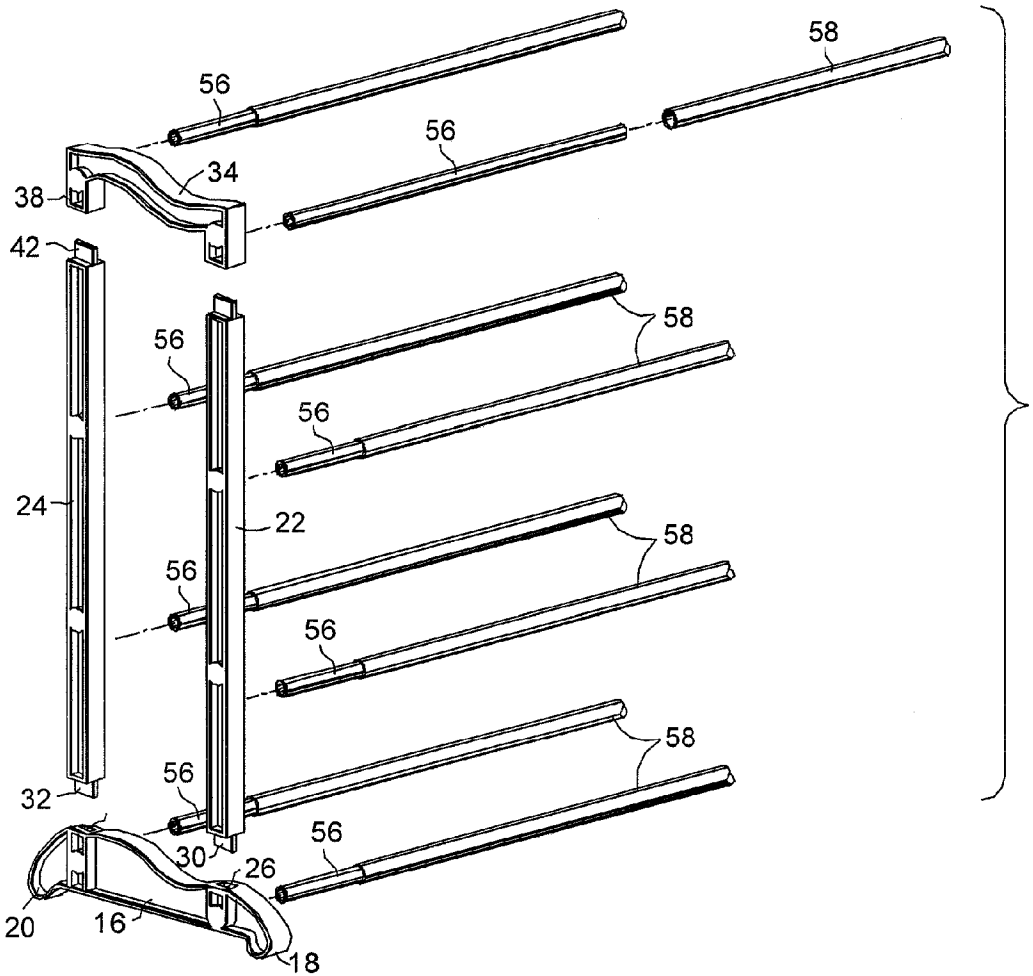
FIG. 3 is an exploded perspective view of parts of the shoe rack shown in FIGS. 1 and 2.

Referring now to the drawings in more detail, numeral 10 generally designates an expansible shoe rack constructed according to a preferred embodiment of the present invention. The shoe rack 10 has a frame that includes opposite sides 12 and 14 that are mirror images of one another. Each of the frame sides 12 and 14 has a base 16 that rests on a floor or other supporting surface. Each base 16 has a front foot 18 and a rear foot 20 that contact the floor. Each frame side 12 and 14 also includes a front upright post 22 and a rear upright post 24. The post 22 and 24 may have an I-beam-type construction and have detachable connections with the base 16 at their lower ends. As shown particularly in FIG. 3, each base 16 has a slot 26 near its front end and another slot 28 near its rear end. The lower end of post 22 is provided with a tongue 30 on its lower end which may be press fit into the forward slot 26. Each of the rear posts 24 similarly has a projecting tongue 32 on its lower end that has a press fit in the rear slot 28. The posts 22 and 24 on each side of the frame are spaced apart and parallel, with the front post 22 located forwardly from the rear post 24.

The upper ends of each pair of posts 22 and 24 are connected by a top beam 34. The beams 34 have downwardly extending legs 36 and 38 on their front and back ends, respectively. The lower end of leg 36 is provided with a slot (not shown) into which a tongue 40 (FIG. 3) on the top end of post 22 is closely received in a press fit. Similarly, a tongue 42 on the top end of each post 24 has a press fit in a slot (not shown) formed in a lower end of leg 38.

Figure 1:
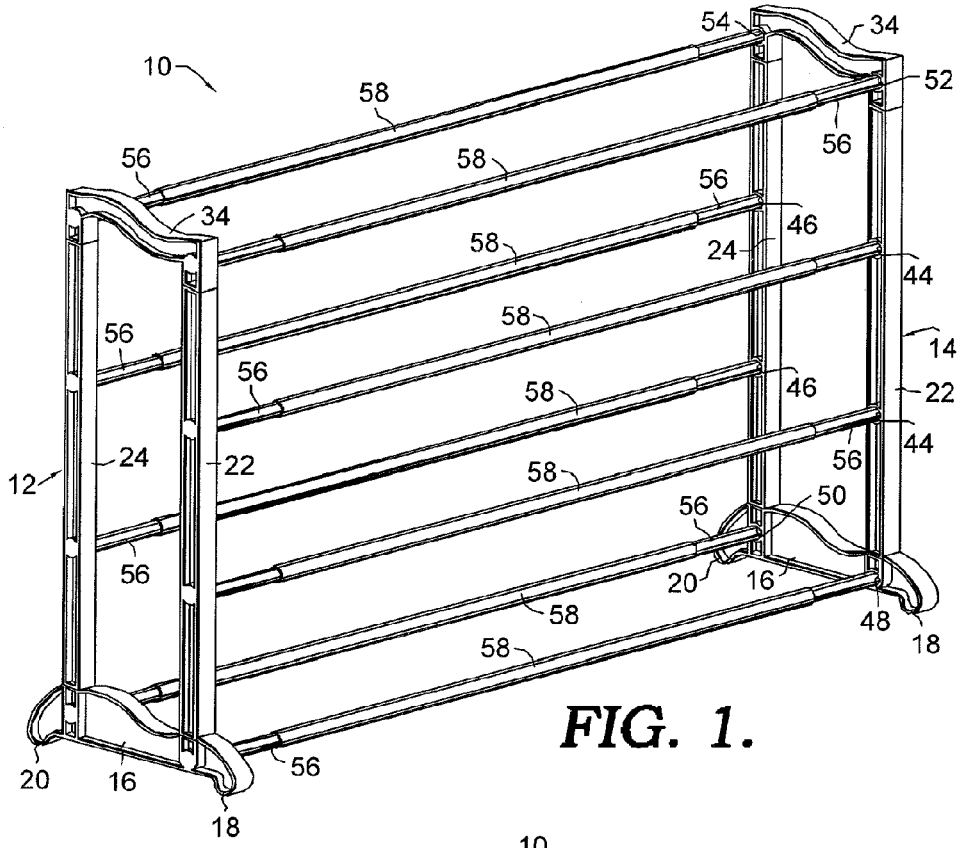
FIG. 1 is a perspective view of an expansible shoe rack constructed according to a preferred embodiment of the present invention.
Figure 2:
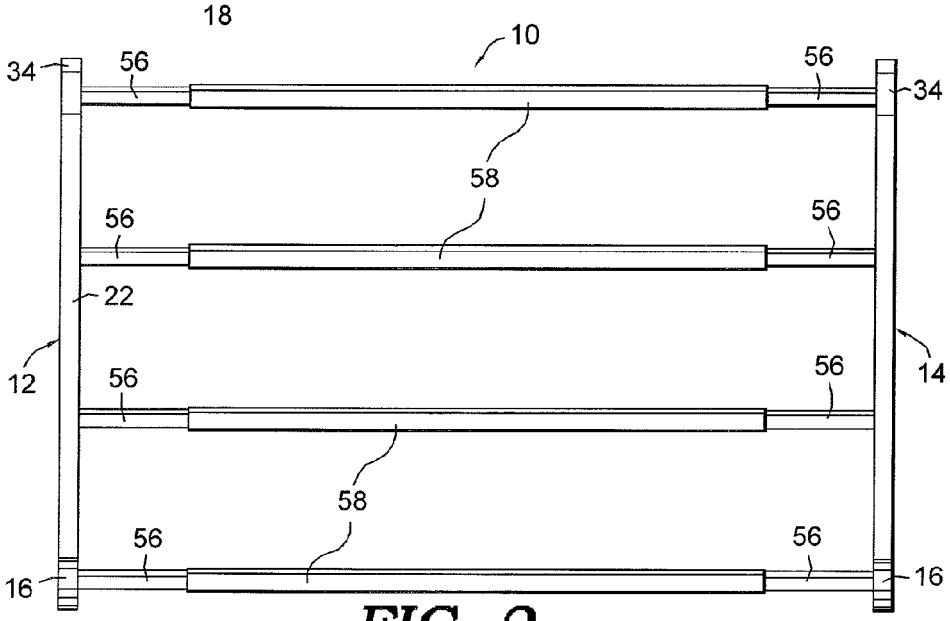
FIG. 2 is a front elevational view of the shoe rack shown in FIG. 1.

With reference to FIG. 1 in particular, each of the front posts 22 is provided with a pair of cylindrical sockets 44 which are spaced apart vertically along the length of each post 22 and face toward the opposing front post on the opposite frame side. Similarly, each of the rear posts 24 is provided on its inside face with a pair of cylindrical slots 46 that are spaced apart vertically substantially the same distance as the sockets 44. Each base 16 is provided on its inside face with a cylindrical front socket 48 and a cylindrical rear socket 50. Each of the top beams 34 is provided with a front cylindrical socket 52 and a rear cylindrical socket 54. The front sockets 44, 48 and 52 are spaced approximately equidistantly apart on the opposite frame sides. Each of the front sockets is horizontally aligned with one of the front sockets on the opposite frame side 12 or 14. The rear sockets 46, 50 and 54 are similarly spaced equidistantly apart and are aligned with the rear sockets on the opposite side of the frame. Sockets 46 are preferably slightly higher than the corresponding front sockets 44, while sockets 50 are preferably located at a slightly higher elevation that sockets 48 and sockets 54 are preferably slightly higher than sockets 52. All of the sockets are cylindrical and have the same diameter and depth.

Figure 4:
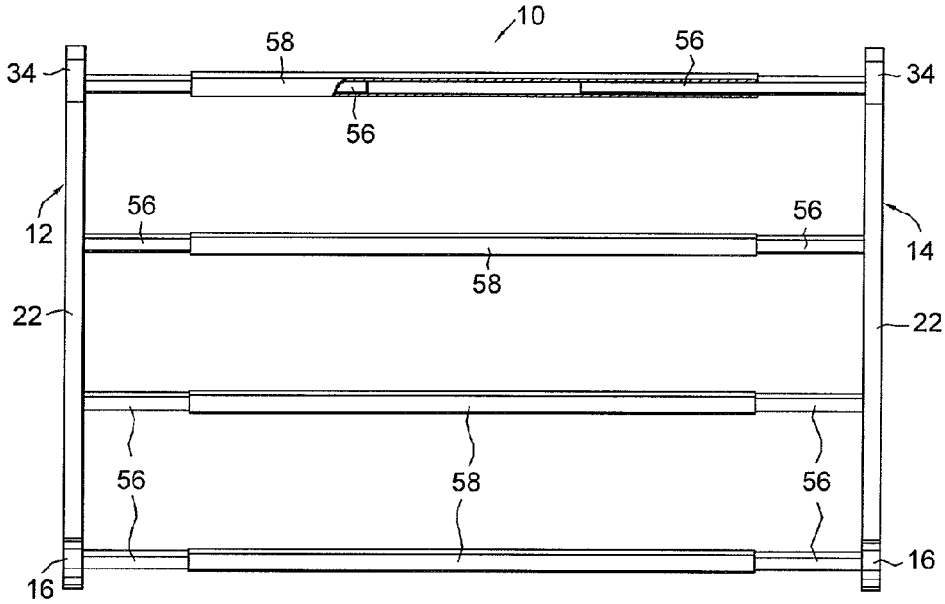
FIG. 4 is a front elevational view similar to FIG. 2, with a portion broken away for illustrative purposes.
Figure 5:
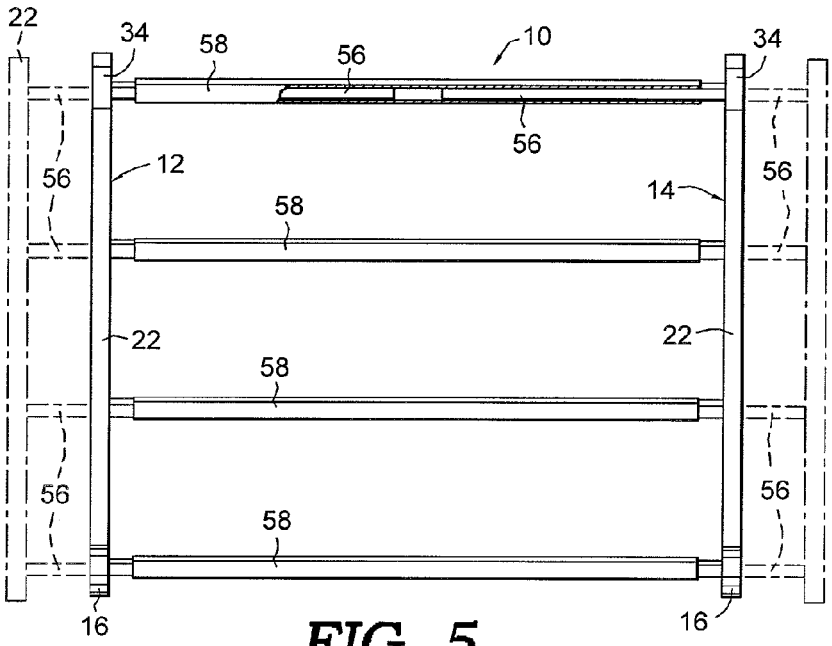
FIG. 5 is a front elevational view similar to FIG. 4, with a portion broken away for illustrative purposes, and with the solid lines showing the shoe rack almost fully contracted and the broken lines showing the shoe rack in a more expanded condition.

The shoe rack 10 includes a plurality of bar assemblies, each of which may take the form of a pair of hollow end bars or tubes 56 and a hollow center bar or tube 58. The end tubes 56 are all tubular and have the same size and shape. The diameter of each end tube 56 is such that it can be inserted closely in one of the sockets 44, 46, 48, 50, 52 and 54 in the frame in a press fit. The center tubes 58 are constructed to have a telescopic fit with each of the end tubes 56 in each bar assembly. As best shown in FIG. 4, the opposite ends of each center tube 58 receive the ends of the corresponding end tubes 56 in a telescopic manner such that the tubes 56 and 58 provide a continuous bar extending between the opposite frame sides 12 and 14. The fit of each tube 56 in tube 58 is preferably a close fit, although the tubes 56 can telescope in and out of tube 58 for adjustment of the length and capacity of the shoe rack 10.

It is preferred for the tube 58 to be considerably longer than the end tubes 56. The tubes 56 are all preferably of the same length. By way of example, each tube 58 may be somewhat less than twice the length of each tube 56. At the same time, it is preferred that the length of each tube 58 be minimized so that the length of the packaging needed to contain the components of the shoe rack 10 can be minimized without sacrificing capacity.

It is contemplated that the shoe rack will be packaged in disassembled form so that it can be contained in a compact package having a length only slightly greater than the length of each tube 58. The consumer or other purchaser of the shoe rack can unpackage the components and assemble them. The frame sides 12 and 14 can be assembled by inserting the tongues 30 and 32 in the slots 26 and 28 of the base 16. The upper tongues 40 and 42 can be applied into the slots (not shown) in the lower surfaces of legs 36 and 38 to connect the top beams 34 on the frame sides. Each of the frame sides 12 and 14 is thus constructed such that it presents a rigid structure which is generally rectangular with the posts 22 and 24 being vertical and connected by the bases 16 at the bottom and the top beams 34 at the top. The end bars 56 may then be inserted into the sockets 44 and 46 of the posts and also into the sockets 48 and 50 of the bases and sockets 52 and 54 of the top beams. The end tubes 52 may then be inserted into the opposite ends of the center tubes 58 to complete the assembly.

When the unit has been assembled, the bar assemblies provided by the telescoping tubes 56 and 58 are arranged in a plurality of tiers, with each tier including one bar assembly at the front portion of the frame and another bar assembly at a slightly higher elevation at the rear portion of the frame. In the illustrated embodiment, there are four different tiers of bars, one defined at the bases 16, two more defined along the posts 22 and 24, and the final top tier defined at the top beams 34.

The shoe rack 10 can be expanded or contracted as desired in order to vary its capacity or adjust its length to fit in whatever space might be available. Because the tubes 56 fit telescopically in the larger center tubes 58, the length adjustment can be carried out quickly and easily. It is noted that the shoe rack 10 can be assembled easily because all of the sockets have the same size, and all of the end tubes 58 have the same size. The center tubes 58 are preferably considerably longer than the end tubes 58 so that they will not be mistakenly driven into one of the sockets and thus possibly damage the frame components. Additionally, the shoe rack 10 can provide the same shoe holding capacity as a two tube telescoping shoe rack while presenting a shorter and more compact package.

While the shoe rack 10 has been shown and described as having sockets in which the end bars 56 are received, other methods of attachment can be provided, including mechanical fasteners such as screws and other fastening systems. Also, shoe racks that hang on a door, wall or other surface can be constructed in accordance with the invention.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A shoe rack comprising: a frame having a pair of opposite frame sides each comprising a base adapted to rest on a support surface and front and rear upright members extending upwardly from said base and having detachable connections therewith; a plurality of front sockets in each of said front upright members spaced vertically apart and substantially aligned with the front sockets in the opposite front upright member, said front sockets each having substantially the same size; a plurality of rear sockets in each of said rear upright members spaced vertically apart and substantially aligned with the rear sockets in the opposite rear upright members, said rear sockets each having substantially the same size; a plurality of front bar assemblies each including a center bar and a pair of end bars having a telescopic fit with opposite ends of said center bar and received detachably in aligned pairs of the front sockets in said front upright members; and a plurality of rear bar assemblies each including a center bar and a pair of end bars having a telescopic fit with opposite ends of said center bar of the rear bar assembly and received detachably in aligned pairs of the rear sockets in said rear upright members, said front and rear bar assemblies cooperating to provide tiers for receiving and holding shoes.

2. A shoe rack as set forth in claim 1 wherein: said end bars of the front end and rear bar assemblies are tubular; and said front and rear sockets are substantially cylindrical.

3. A shoe rack as set forth in claim 2, wherein: said center bar of each front bar assembly is tubular and has a size to receive said end bars of the front bar assembly in a telescopic fit; and said center bar of each rear bar assembly is tubular and has a size to receive said end bars of the rear bar assembly in a telescopic fit.

4. A shoe rack as set forth in claim 1, wherein: said center bar of each front bar assembly is tubular and has a size to receive said end bars of the front bar assembly in a telescopic fit; and said center bar of each rear bar assembly is tubular and has a size to receive said end bars of the rear bar assembly in a telescopic fit.

5. A shoe rack as set forth in claim 1, wherein: said end bars of each front bar assembly are all substantially equal in length; and said center bar of each front bar assembly has a length less than twice the length of each end bar of the front bar assemblies.

6. A shoe rack as set forth in claim 1, each base has one of said front sockets and one of said rear sockets; each front upright member has at least one of said front sockets; and each rear upright member has at least one of said rear sockets.

7. A shoe rack as set forth in claim 6, wherein each frame side comprises a beam extending between the respective front and rear upright members at upper ends thereof, each of said beams having one of said front sockets and one of said rear sockets.

8. A shoe rack as set forth in claim 7, wherein each of said upright members has a detachable connection with said base and said beam.

9. A self-standing shoe rack for support on a floor surface comprising: a frame having opposite sides spaced apart from one another a variable distance, each frame side having a base for application to a floor surface and front and rear upright members extending upwardly from said base; a plurality of substantially equally-sized sockets in each of said upright members spaced apart vertically with the sockets in each front upright member being substantially aligned horizontally with the sockets in the other front upright member and the sockets in each rear upright member being substantially aligned horizontally with the sockets in the other rear upright member; a plurality of end bars each received at one end in one of said sockets; and a plurality of center bars each connected telescopically with a pair of the end bars to cooperate with the end bars to form a plurality of tiers of supports, each tier comprising center and end bars extending between said front upright members and center and end bars extending between said rear upright members, said center and end bars being telescopically adjustable in and out of one another to adjust a length dimension of said tiers between said opposite sides of said frame.

10. A shoe rack as set forth in claim 9, wherein said center and end bars are tubular.

11. A shoe rack as set forth in claim 9, wherein: said end bars all have substantially the same length; and said center bars all have substantially the same length less than twice the length of the end bars.

12. A shoe rack as set forth in claim 9, wherein: said end bars are tubular; and said sockets are substantially cylindrical and sized to receive the end bars.

13. A shoe rack as set forth in claim 12, wherein said end bars fit telescopically inside of said center bars.

14. A shoe rack as set forth in claim 9, including on each frame side a beam extending between said front and rear upright members at upper ends thereof.

15. An expansible shoe rack for application to a support surface, comprising: a pair of base members applicable to the support surface at spaced apart locations; a pair of upright members for each base member comprising a front upright member and a rear upright member each having a detachable connection with said base member at bottom ends of said upright members; a pair of beams each having a detachable connection with the respective front end rear upright members at upper ends thereof; a plurality of end bars; a plurality of center bars each having a telescopic fit with a pair of said end bars to cooperate therewith to form a continuous bar structure for supporting shoes, said bar structures extending between and connected with said front upright members and extending between and connected with said rear upright members to provide a plurality of tiers of bar structures for supporting shoes.

16. A shoe rack as set forth in claim 15, wherein: said end bars are tubular; and said center bars are tubular and sized to receive said end bars inside of said center bars.

17. A shoe rack comprising: a frame having a pair of opposite frame sides each including an upright member and frame portions spaced away from said upright member; a plurality of end bars; and a plurality of center bars each having a telescopic fit with a pair of said end bars to cooperate therewith to form a continuous bar structure for supporting shoes, said bar structures extending between and connected with said upright members and extending between and connected with said frame portions to provide a plurality of tiers of bar structures for supporting shoes, said center and end bars being telescopically adjustable in and out of one another to adjust a length dimension of said bar structures between said upright members and between said frame portions.

18. A shoe rack comprising: a frame having a pair of opposite frame sides adapted to rest on a support; a plurality of front sockets in each frame side spaced vertically apart and substantially aligned with the front sockets in the opposite frame side, said front sockets each having substantially the same size; a plurality of rear sockets in each frame side spaced vertically apart and substantially aligned with the rear sockets in the opposite frame side, said rear sockets each having substantially the same size; a plurality of front bar assemblies each including a center bar and a pair of end bars having a telescopic fit with opposite ends of said center bar and received in aligned pairs of the front sockets in said opposite frame ends; and a plurality of rear bar assemblies each including a center bar and a pair of end bars having a telescopic fit with opposite ends of said center bar of the rear bar assembly and received in aligned pairs of the rear sockets in said opposite frame sides, said front and rear bar assemblies cooperating to provide tiers for receiving and holding shoes, said center and end bars being telescopically adjustable in and out of one another to adjust a length dimension of said tiers between said opposite frame sides.

* * * * *